US007341253B2

(12) United States Patent
Lingenfelser

(10) Patent No.: US 7,341,253 B2
(45) Date of Patent: Mar. 11, 2008

(54) GAME PLAYED USING A BOARD AND FORMING WORDS

(76) Inventor: Lynda Lee Lingenfelser, 3284 Spruce Creek Glen, Port Orange, FL (US) 32128

( * ) Notice: Subject to any disclaimer, the term of this patent is extended or adjusted under 35 U.S.C. 154(b) by 0 days.

(21) Appl. No.: 11/429,771

(22) Filed: May 8, 2006

(65) Prior Publication Data

US 2007/0257434 A1 Nov. 8, 2007

(51) Int. Cl.
*A63F 3/00* (2006.01)

(52) U.S. Cl. ..... 273/272; 373/243

(58) Field of Classification Search ..... 273/272, 273/242, 243; 434/167, 171, 172
See application file for complete search history.

(56) References Cited

U.S. PATENT DOCUMENTS 4,306,724 A * 12/1981 Brzezinski et al. ..... 273/243
6,769,692 B1 * 8/2004 Cavalluzzo ..... 273/272
6,986,513 B1 * 1/2006 Ferrante ..... 273/272

* cited by examiner

*Primary Examiner*—William M. Pierce

(57) ABSTRACT

A board game wherein the players state in advance of their turn any words they choose to form, then state their choice to roll both dice to maneuver the game board with their game piece or to roll one die to pick the corresponding number of lettered squares. A player must earn twenty points in any form before using the point board. The player earns their choice of point chips for later usage or pegs for the point board for forming words. A player must fill each section on the point board before the player proceeds with the game piece to the corresponding level on the game board. A player must complete all other sections on the point board before completing the final section, where the player must form five words of any length, only one per turn, to complete the final section and win the game.

8 Claims, 8 Drawing Sheets

Roll all 5 of the lettered dice.
Earn twice the value of points
for any one word formed.

GAME PLAYED USING A BOARD AND FORMING WORDS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

This is a board game comprised of the game board for use by all players and a point board for each player for all players to visually see the progress of each player towards winning the game. The game board provides a way of earning additional points with which to acquire pegs. A player has to earn twenty points, whether by forming words or by moving around the game board in a clockwise manner. Then, after the player earns the twenty points, the player may begin using the point board. A player has the option of rolling the dice to move the player's game piece around the game board, or to roll one die and pick the number of lettered squares as indicated on the dice. When each section on the point board is filled, the player proceeds with the player's game piece to the associated level on the game board. When section one on the point board is completed or filled, the player immediately proceeds with the player's game piece to the level one square designating the starting point on level one of the game board at which point the turn is concluded. Sections two and three are played in the same manner. The player can move around the board on the highest numbered level earned or any previous levels by entering the desired level at the starting square labeled with the level number. A player cannot, however, jump a level but must move to the next numbered level during regular play and move around the level until reaching the square designated as the next subsequent level. The final section cannot be played until sections one, two, and three are filled. Only one word, of any length, can be formed at each turn when filling the final section. Words are formed for points, and pegs to fill sections one, two, three and finally the final section on the point board to win the game.

2. Description of the Prior Art

There are a number of games involving the creating of words, where some do not allow for the player to have many, if any, alternate choices for the way in which to make a play. Some rely on a method for scoring where a player is responsible for writing down various information throughout the game in order to keep track of the score. In this event, it is difficult for other players to easily observe the other players' score and their progress in the game. The present invention sees to overcome these problems and provide players with the opportunity to play a challenging and entertaining game, easily observe the other players' progress towards winning the game, and play a game that they may potentially benefit from through educational enrichment due to the ongoing process of forming words and the opportunity to strategize.

SUMMARY OF THE INVENTION

There are a number of games requiring that a player form a word, which shows the ongoing interest in forming words in a game. This invention looks to satisfy the need for a new board game utilizing the forming of words and to visually see the points earned and progress towards winning the game. Unlike prior art, this invention issues points for words formed in the way of pegs to be used on a player's point board or points for point chips to be used at the players' discretion. A player may utilize strategy each turn by opting to roll the dice to proceed around only the perimeter of an earned level or levels of the game board or to roll one die to pick the associated number of lettered squares. The present invention is novel, new and useful where it is challenging, entertaining, and educational. The present invention is educational in terms of utilizing a strategy to play the game and where the forming of words is up to the player. The present invention is a board game where players earn points by forming words with lettered squares and move a game piece around the game board to earn additional points which are used at the player's discretion to acquire pegs which are played on each player's point board. Sections one, two, and three must be filled before filling the final section on their point board to win the game.

The present invention offers a variety of options for strategic play where some are mentioned in more detail as follows: Whether to roll the dice to advance on the game board, or to roll one die to choose lettered squares; whether to accumulate point chips in lieu of a peg or pegs for a specific section in order to turn in the point chips for a peg or pegs for another section later; whether to turn in many chips at one time to quickly fill a section; whether to fill in each section one at a time so that the player can advance to the next level on the game board with their game piece sooner and potentially acquire additional points; whether to fill in each section, one at a time, in order to acquire the additional bonus point for each word in the next section; whether to save lettered squares to form six letter words to earn the bonus twenty five points in point chips and an additional turn or to form multiple shorter words and acquire multiple pegs; whether to move the player's game piece around the game board on the highest level achieved or to observe the dice rolled and count out the best possible move by comparing the player's ending position based on the number of squares the player would move on the current level versus counting and moving the squares back to the previous level, or forward to the next level if possible to land on a square offering the most advantageous position to the player.

The object of the game is to earn as many points as possible, most of which are earned by forming words, where a peg is earned for each word formed or point chips, the value of which depends on the length of the word formed. A three letter word earns a peg to be placed in section one on the point board or five points in point chips; a four letter word earns a peg to be placed in section two or ten points in point chips; a five letter word earns a peg to be placed in section three or fifteen points in point chips; a 6 letter word does not earn a peg but earns twenty five points in point chips and another turn.

After completing all three sections the player must form five words of any length, but only one per turn, to complete the final section on the player's point board, which may be in the shape of a diamond, to score the final points of the total 720 points necessary to win the game.

Another feature of this invention is that it should take a reasonable length of time to play, and depends on whether there are 2, 3, 4, 5, or 6 players.

Another feature of this invention is that, where all players agree in advance, an abbreviated game may be played where the first player to fill in the predetermined number of sections of the point board wins the game.

DETAILED DESCRIPTION OF THE INVENTION

Figure 1:
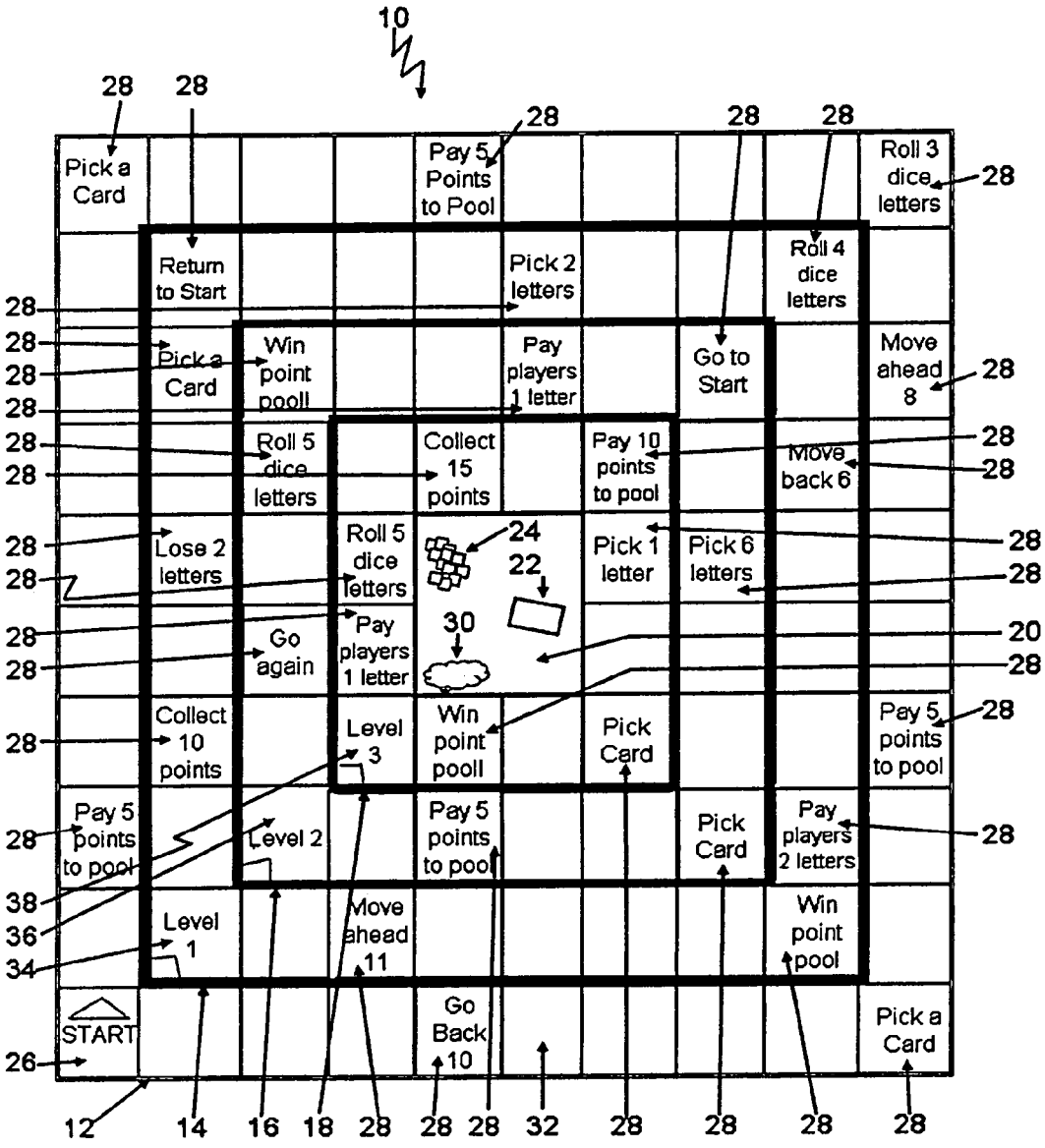
FIG. 1 is a top plan view of this present invention's game board.
Figure 4:
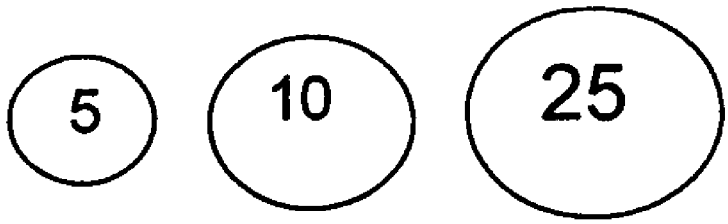
FIG. 4 is a perspective view of the point chips.
Figure 8:
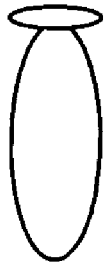
FIG. 8 is a perspective view of a peg to be used on the point board.

The present invention is played by 2, 3, 4, 5, or 6 players. The total number of squares on the game board 10 on which to move a game piece is 96. For purposes of illustration, one of the 96 squares is referred to as 32 on FIG. 1. The game board 10 is comprised of the outer perimeter of squares called the standard playing area and is comprised of 36 boxes that shall be referred to as 12 on FIG. 1; the next inner perimeter of squares is called level one, or may be called the blue level, that is comprised of twenty eight squares and shall be referred to as 14 on FIG. 1; the next inner perimeter of squares called level two, or may be called the silver level, that is comprised of 20 squares and shall be referred to as 16 on FIG. 1; the next inner perimeter of squares called level three, or may be called the gold level, that is comprised of 12 squares and shall be referred to as 18 on FIG. 1. There is a middle area 20 that may be used for the instructional deck of cards 22 (FIG. 5B), the lettered squares 24 (FIG. 6), and the point chips pool 30. A player is chosen before each game to be responsible for handing out pegs (FIG. 8), and handing out and receiving back point chips (FIG. 4).

Figure 3:
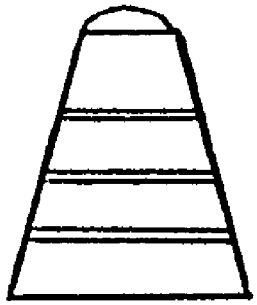
FIG. 3 is a perspective view of a game piece used by each player, which may be differentiated by color.
Figure 9:
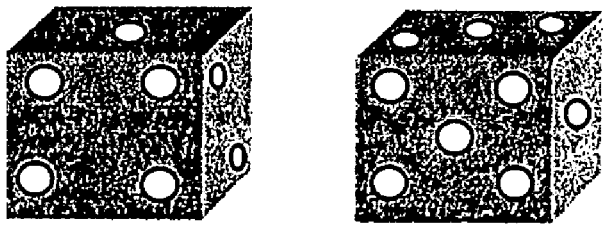
FIG. 9 is a view of the two 6 sided dice that are used during play of the game with one to six dots on each die.

The game begins with each player on the Start square 26. It is decided who begins by each player picking a letter from the stack 24 in the middle area 20 and the closest to the letter "A" begins first. Each player takes a turn in a clockwise manner. A player has the option of rolling the two dice (FIG. 9) to move the game piece (FIG. 3) on the squares of the outer perimeter called the standard playing area 12 around the board in a clockwise manner, or by rolling one die to determine the number of lettered squares (FIG. 6) 24 to pick that are face down either on the middle area 20 of the board or in a location agreed upon by all players and in a location accessible by all players. There are 189 assorted lettered squares from which to choose at the start of the game. If a player chooses to form a word or words, or to turn in point chips (FIG. 4) for a peg or pegs (FIG. 8) it must be done immediately before their play.

Figure 2:
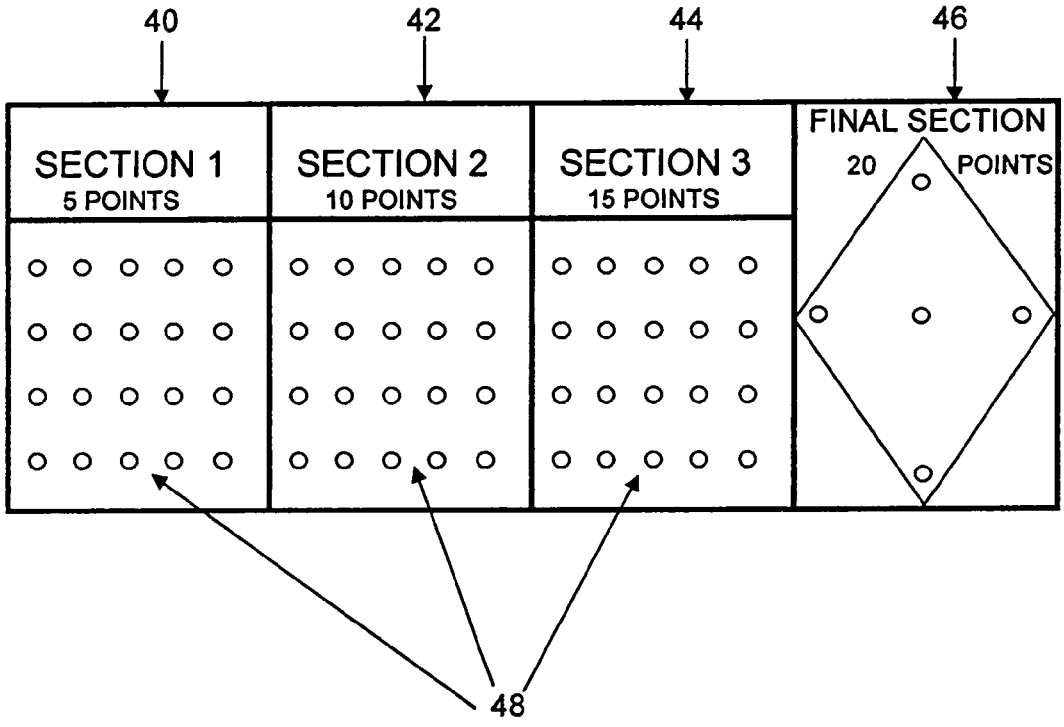
FIG. 2 is a top plan view of the point board used by each player.

Each player moves around the standard playing area 12, in a clockwise manner until the player earns twenty points. Once the initial twenty points is attained, the player must show and turn in the twenty points in point chips so that the player can then begin play with the point board (FIG. 2). The player earns points that may be used for pegs (FIG. 8) to fill in the peg holes 48 in the sections on the player's point board (FIG. 2), or the player may take the equivalent value in point chips (FIG. 4). Pegs cannot be retained for future use, and must be played in the appropriate section when accepted for forming a word or when taken for turning in point chips (FIG. 4). Section one 40 is for pegs (FIG. 8) earned for forming a three letter word and each is worth five points in point chips (FIG. 4) or one peg. Section two 42 is for pegs (FIG. 8) earned for forming a four letter word and each is worth ten points in point chips (FIG. 4) or one peg. Section three 44 is for pegs (FIG. 8) earned for forming a five letter word and each is worth fifteen points in point chips (FIG. 4) or one peg. A player earns their choice of a peg (FIG. 8), or equal value of point chips (FIG. 4) at the time a word is formed. Once a player has filled in all peg holes 48 with pegs (FIG. 8) in section one 40, which may be called the blue section of their point board (FIG. 2), the player immediately moves the player's game piece (FIG. 3) to the level one square 34 which is the starting point for level one 14 which may be called the blue level on the game board 10 and during subsequent turns the player may proceed around the board on level one 14, or the standard playing area 12. When section two 42 on a player's point board (FIG. 2) is filled, the player immediately moves the player's game piece (FIG. 3) on the game board 10 to the level two square 36 which is the starting point for level two 16 which may be called the silver level and during subsequent turns the player may proceed around the board on level two 16, level one 14, or the standard playing area 12. Once section three 44 is filled, the player immediately moves their game piece (FIG. 3) on the game board 10 to the level three square 38 which is the starting point for level three 18 which may be called the gold level and during subsequent turns the player may proceed around the board on all levels.

A player can move between levels earned, but can only move to an adjacent level and cannot jump a level. A player must enter a given level at the level's starting point as previously described.

Section one 40, section two 42, and section three 44 on the point board (FIG. 2) have twenty peg holes each. A peg (FIG. 8) earned for forming a three letter word is worth five points and can only be placed in section one 40 thereby making the completed section worth 100 points. A four letter word formed is worth ten points or a peg (FIG. 8) that can only be used in section two 42 thereby making the completed section worth 200 points. A five letter word formed is worth fifteen points or a peg (FIG. 8) that can only be used in section three 44 thereby making the completed section worth 300 points.

Forming a six letter word earns the player twenty five points in point chips (FIG. 4) and another turn. A player may earn a peg (FIG. 8) for a four letter word and place it in section two 42 on the point board (FIG. 2) or a player may earn a peg for forming a five letter word and place it in section three 44 even if section one 40 on the point board (FIG. 2) is not yet complete, or they can take the equivalent points in point chips (FIG. 4). When a player has completely filled in section one 40, any words formed that are four letters in length for section two 42 automatically are worth a bonus of one point each. When a player has completely filled in section two 42, any words formed that are five letters in length for section three 44 are automatically worth a bonus of one point each. Point chips (FIG. 4) may be retained for future plays, but cannot be turned in for pegs for the final section 46 on the point board (FIG. 2).

On the game board 10, if a player lands on any square occupied by another player, the player landing on the square earns ten points in point chips (FIG. 4).

On the game board 10, if a player lands on as instruction square 28 or is instructed to pick an instructional card (FIG. 5A) from the deck 22 (FIG. 5B) and told to pay points to the point pool 30 or to another player and the player does not have sufficient points, the player must provide as many point chips (FIG. 4) as they have at that time. The point chips pool 30 is illustrated on FIG. 1 and is an area designated as a repository for point chips. Players may be instructed to pay point chips (FIG. 4) to, or win point chips from, the point chips pool 30.

Figures 5A, 5B:
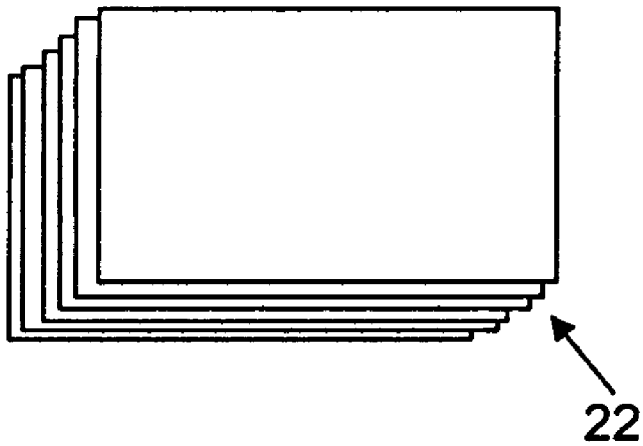
FIG. 5A. is a sample of an instructional card.
FIG. 5B. is an illustration of the deck of instructional cards.
Figure 6:
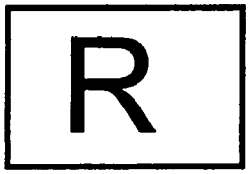
FIG. 6 is a plan view of a sample lettered square.
Figure 7:
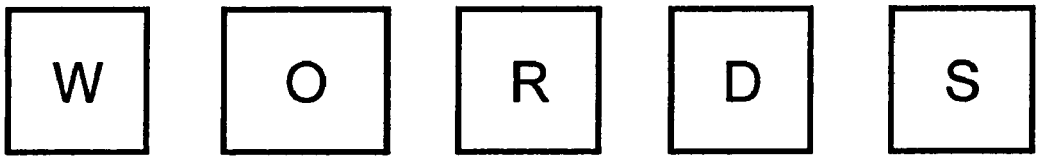
FIG. 7 is a plan view of the five (5) lettered dice that are six sided with a letter on each side.

Instruction squares 28 or instruction cards 22 (FIG. 5B) may instruct a player to roll a specified number of lettered dice (FIG. 7) for extra points. A player must follow instructions on an instructional square 28 or instruction card 22 (FIG. 5B).

The final section 46 is for words of any length, but where only one word may be formed per turn with a point value of twenty for each peg (FIG. 8), to win the game.

Figure 10:
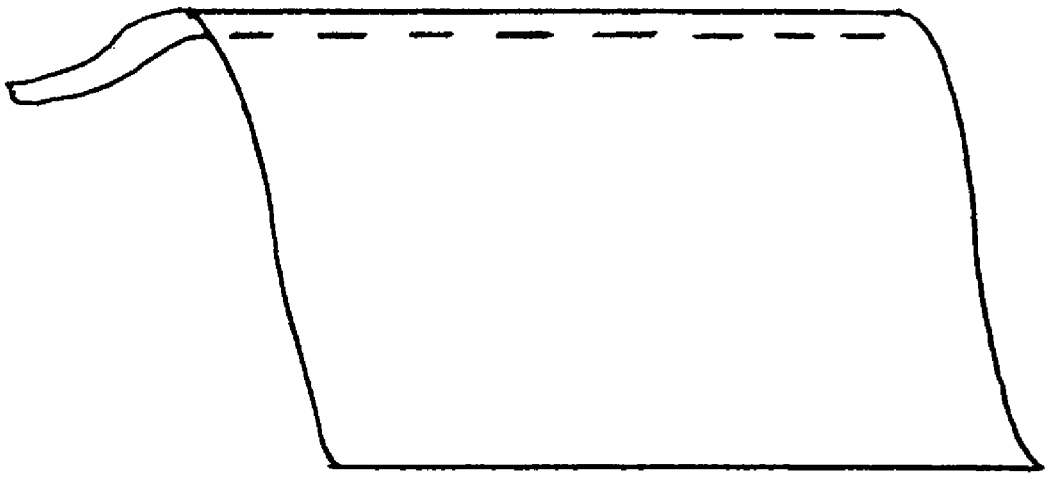
FIG. 10 is a perspective of a drawstring bag.

A drawstring bag (FIG. 10) is to hold all of the pieces of the game with the exception of the game board.

Figure 11:
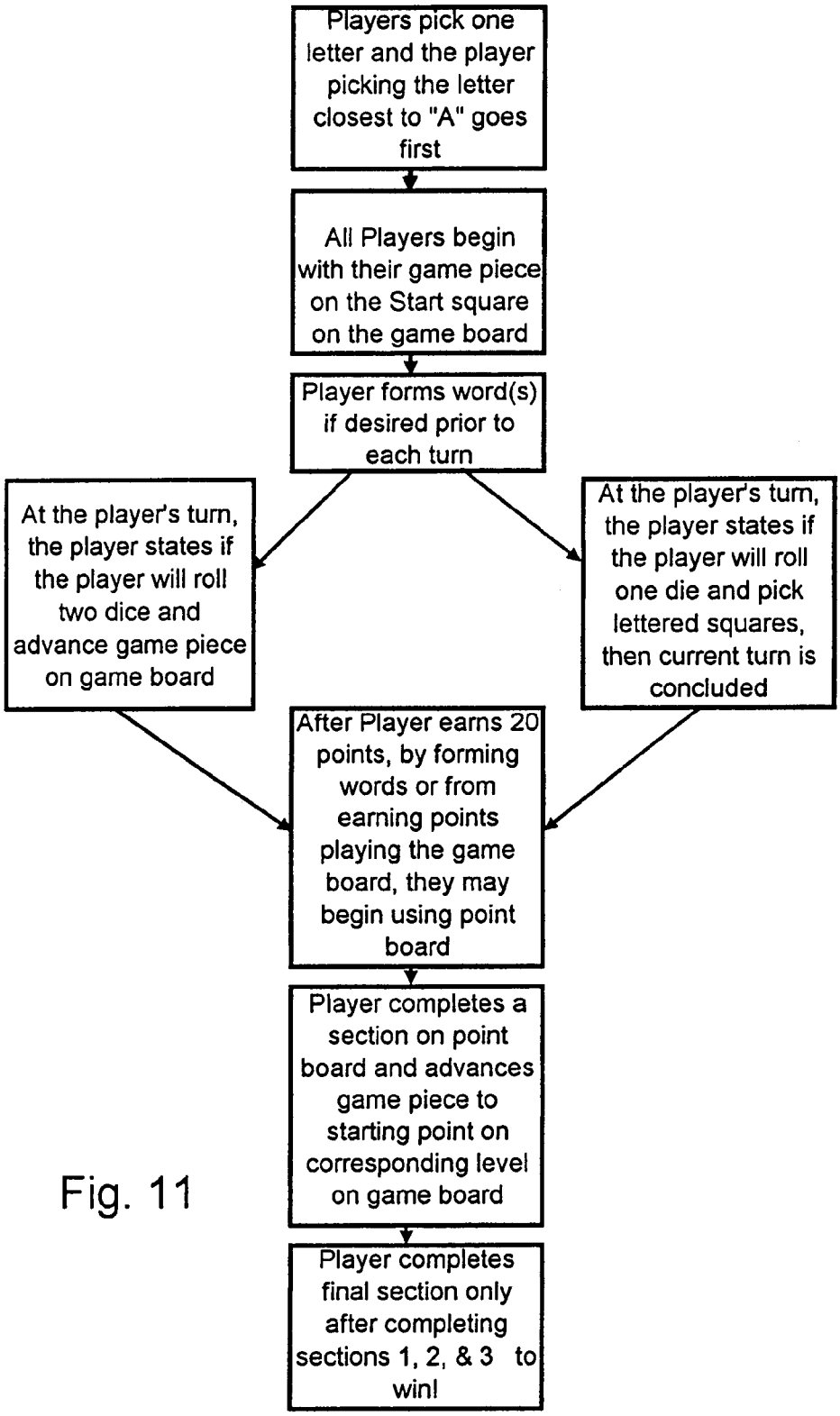
FIG. 11 is a flow chart describing the preferred method of playing the present invention.

A flow chart (FIG. 11) illustrates the preferred method for playing the game.

The descriptions and drawings are intended not to be limited to that shown. Various alternatives and modifications can be made without departing from the invention.

I claim:

1. Method of playing a game with a number of persons, the steps comprising;

providing a main game board with a plurality of sequential squares forming an outer perimeter of squares having a start square, an inner perimeter of squares with a level one square, a second inner perimeter of squares with a level two square, a third inner perimeter of squares with a level three square and a middle area, providing a plurality of game pieces, two dice, a deck of instructional cards, a stack of lettered squares, five lettered cubes, point chip pool and pegs, choosing a player to be responsible for handing out pegs and handing out and receiving back point chips and providing each player with a game piece on the start square and a personal point board having three sections and a final section with holes, a player given an option of forming a word or words from any lettered squares in their possession or turn in any point chips in their possession to receive a peg or pegs, a player choosing the option of rolling the two dice to move a game piece on the squares of the outer perimeter or rolling one die to determine a number of lettered squares to pick, each player receiving point chips or pegs for any words formed, whereby a number of said point chips may be turned in for pegs, a player moving said game piece around the outer perimeter of said main game board until the player earns twenty point chips which may be used for pegs, filling the holes of the players point board when a peg is received, filling the holes of a first section of said point board with pegs received for forming a three letter word and each is worth five points in point chips or one peg, the holes of a second section with pegs received for forming a four letter word and each is worth ten points in point chips or one peg and filling the holes of a third section with pegs received for forming a five letter word and each is worth fifteen points in point chips or one peg, a player moving his game piece to the level one square once a player has filled in all peg holes in said first section, a player moving his game piece to the level two square when said second section is filled, a player moving his game piece to the level three square when said third section is filled.

2. The method of claim 1, wherein player receiving 10 points in point chips if player lands on any square occupied by another player.

3. The method of claim 1, wherein providing instructional squares on said game board and a player picking an instructional card if a player lands on an instruction square.

4. The method of claim 1, wherein providing a drawstring bag to hold all of the pieces of the game with the exception of the game board.

5. The method of claim 1, wherein players choosing a dictionary agreed to by all players to verify words played.

6. The method of claim 5, wherein receiving no penalty for a word spelled incorrectly or the forming of a non-word except that the word cannot be used.

7. The method of claim 1, wherein rolling a double on the dice player moves game piece on said game board and rolls dice again.

8. The method of claim 1, further comprising the steps of: filling the holes of a final section of said point board with one peg per turn for forming a word of any length once player has filled a first section, a second section, and a third section of player's point board.

* * * * *